US006289966B1

(12) United States Patent
Hoermann

(10) Patent No.: US 6,289,966 B1
(45) Date of Patent: Sep. 18, 2001

(54) DOOR

(75) Inventor: Michael Hoermann, Halle (DE)

(73) Assignee: Marantec Antriebs-und Steverrungstechnik GmbH & Co. KG, Marienfeld (DE)

( * ) Notice: Subject to any disclaimer, the term of this patent is extended or adjusted under 35 U.S.C. 154(b) by 0 days.

(21) Appl. No.: 09/513,604

(22) Filed: Feb. 25, 2000

(30) Foreign Application Priority Data

Feb. 26, 1999 (DE) ..... 299 03 517 U

(51) Int. Cl.[7] ..... E05D 15/16
(52) U.S. Cl. ..... 160/191; 160/201
(58) Field of Search ..... 160/201, 193, 160/190, 191, 192; 49/200

(56) References Cited

U.S. PATENT DOCUMENTS 2,538,626 * 1/1951 Olsen ..... 160/193
2,992,450 * 7/1961 Pittenger ..... 160/192
3,012,520 * 12/1961 Curtis ..... 160/193
4,177,854 * 12/1979 DeVore .
5,168,914 * 12/1992 Keller .
5,343,923 * 9/1994 Keller .
6,199,617 * 3/2001 Schweiss .

FOREIGN PATENT DOCUMENTS

556668 * 6/1956 (CA) ..... 49/200
29805716 6/1998 (DE) .
0648307 4/1995 (EP) .

* cited by examiner

*Primary Examiner*—Blair M. Johnson
(74) *Attorney, Agent, or Firm*—Dillworth & Barrese LLP.

(57) ABSTRACT

The invention refers to a door with a door leaf consisting of one or more members that can swivel relative to each other, which is movable in a frame mounted on a building, guided on the side, from a vertical closed position into at least an approximately horizontal open position, where the door has a counterweight unit that is formed of at least one helical spring mounted on a horizontal pinion and that can be pre-tensioned by means of rotation, where the pinion is mounted directly on the door leaf with the helical spring. According to the invention, the pinion is mounted on the upper section of the door leaf in the closed state of the door.

19 Claims, 5 Drawing Sheets

DOOR

The invention concerns a door formed with a door leaf consisting of several members that can swivel relative to each other, which is moveable in a frame mounted on a building, guided on the side, from a vertical closed position into at least an approximately horizontal position, wherein the door has a counter weight unit that is formed of at least one helical spring mounted on a horizontal pinion and that can be pre-tensioned by means of rotation, wherein the pinion is mounted directly on the doorleaf with the helical spring.

Such doors, consisting of several members that can swivel relative to each other, are described, depending on the form and size of the individual door leaf members, as lamella doors or as sectional doors. The individual members of the door leaf are guided at the side in the rails of a frame mounted to a building and can be moved from a closed vertical position into at least an approximately horizontal open position, generally by a drive. To avoid the door drive's having to lift the entire weight of the door leaf from the current closed position, the fat that a counterweight unit for the door leaf should be provided is already known. For example, wound traction spring units are known that are located in the area of the horizontal slide rails sections. Such wound traction spring units are, however, extremely disruptive due to their location in the ceiling area and require relatively long springs that must provide for the lifting the entire door leaf.

From EP 0 648 307 B1, we also know how to provide a counterweight unit that is formed of two helical springs that can be pre-tensioned by rotation. This counterweight unit is mounted to the building in the area of the lintel of the building opening and the helical springs operate, in the pre-tensioned state, with one end on a flange fixed to a rotating pinion. By means of this pinion, the helical springs can be pre-tensioned from the outside, without problem. The other end of the helical spring acts on a cable drum that, on the one hand, accepts the end of a cable in a fixed manner, while the other end of the cable is attached to the lower section of the door leaf. Using the pre-tensioned helical springs, the weight of the door leaf to be raised or lowered can be offset. Such a counterweight unit does, however, present the disadvantage that a relatively great lintel height is needed that is lost for the installation height of the door leaf since this previously-known counterweight unit can be mounted only above the door leaf.

To solve this problem, the counterweight unit was placed directly in the lower section of the door leaf according to the theory in DE 298 05 716 U. This means that the pinion with the helical spring is placed directly on the lower section of the door leaf. At the end projecting to the side over the door leaf, at least one drive wheel each is placed that meshes positively with the strips corresponding to the drive wheel, attached to the building at the side of the door leaf. This solution has the disadvantage that the entire counterweight unit, located on the lower section of the door leaf, i.e., generally on the lowest door leaf lamella, must be raised and lowered with the entire door. This means, for one thing, that the counterweight unit must be larger in dimension (and therefore heavier) or, for another, a greater force must be exerted when lifting the door leaf.

SUMMARY OF THE INVENTION

The object of this invention therefore is to develop a generic door such that, on the one hand, it can be mounted to save space with particularly low lintel heights, and, on the other, the dead weight to be moved is kept as low as possible.

According to the invention, this task is solved starting from a generic door as described above by the combination of characteristics in the pinion being mounted on the upper section of the door leaf when the door is closed. According to this, the pinion is placed on the upper section of the door leaf in its closed position.

With this solution, the counterweight unit, on the one hand, is located directly on the door so that only low lintel heights are required. On the other hand, the counterweight unit does not need to be moved up and down over the height of the door opening. Rather, the heavy counterweight unit, referred to the total weight of the door, is essentially moved vertically with the topmost swiveling member of the door leaf.

This basic solution concerns a counterweight that advantageously comes in an embodiment that can be hand-operated as well as an automated, motor-activated embodiment.

The preferred methods of embodiment of the invention can be derived from the description herein.

According to an initial method of embodiment of the invention, the pinion, with the minimum of one helical spring, can have at least one drum from which a traction means can be unwound, working against the spring force of the helical spring, and that is guided around at least one deflection point on the lower section of the door leaf, where the free end of the traction means, referred to the closed door, is mounted on the upper range thereof on the fixed frame or the building.

According to a preferred method of embodiment, a drum is mounted at each end of the horizontal pinion in a torsion-resistant manner in relation to the pinion. The traction means that can be wound around the drum are guided to the side of the door leaf. Such traction means are preferably the cables standard in the industry.

Rollers are placed at the side of the members of the door leaf, by means of which the door is advantageously guided in the side guides of the frame.

The minimum of one traction means can be guided around the roller on the bottommost member of the door leaf or its mounting device. A roller provided for the guidance of the traction means can also be provided on the mounting device, before the roller that runs in the side guides.

Guide rollers can advantageously be mounted for side guidance of the minimum of one traction means on the door leaf.

Instead of these guide rollers, however, fixed guide pins can also be mounted, along which the traction means can be guided parallel to the door leaf.

In the area of these abovecited guide pins or guide rollers for the traction means, an L-shaped bent sheet can be mounted that extends from the pin or roller over the width of the door leaf member, where the upright part of the L-shaped sheet stands vertically upright from the side edge of the door leaf. This sheet forms a safety device for the traction means running to the side of the door leaf members and serves to hold the traction means even when the door is pulled up parallel to the side edge of the door leaf.

According to another preferred method of embodiment, a guide rail with integrated drive means can be mounted along the line of motion of the pinion, with which guide rail a transfer member is operationally connected with the horizontal pinion in a rotation-resistant manner.

This drive means integrated into the guide rail can, for example, be formed as a chain or toothed belt while the force transfer member connected in a rotation-resistant manner with the horizontal pinion is formed as a chain wheel or toothed wheel.

As an alternative, the guide rails can even be formed as a rack profile, while the force transfer member connected in a rotation-resistant manner to the horizontal pinion is formed as a toothed disk.

Finally, a friction surface can be mounted in the guide rail as an integrated drive means, while the force transfer member connected with the horizontal pinion in a rotation-resistant manner is a friction wheel.

In addition to or instead of the minimum of one helical spring mounted on the horizontal pinion, the pinion can be given a drive motor. In the case of the first alternative of this advantageous method of embodiment, the torque necessary to raise and lower the door can be introduced directly by means of a drive motor, designed for example as an electric motor. However in principle, it is also conceivable, within the framework of the invention for the drive motor operationally connected with the pinion to replace the entire helical spring arrangement on the pinion. The drive motor must then be sized sufficiently large to be able to raise and lower the entire weight of the door leaf.

BRIEF DESCRIPTION OF THE DRAWINGS

Further details and advantages of the invention are explained in greater detail based on the methods of embodiment shown in the figures. They show:

FIG. 1, 1*a*, 1*b*, and 1*c*: a schematic cross-section and enlargements of parts of this section of an initial method of embodiment of the door according to the invention.

DESCRIPTION OF THE PREFERRED EMBODIMENTS

Figure 1:
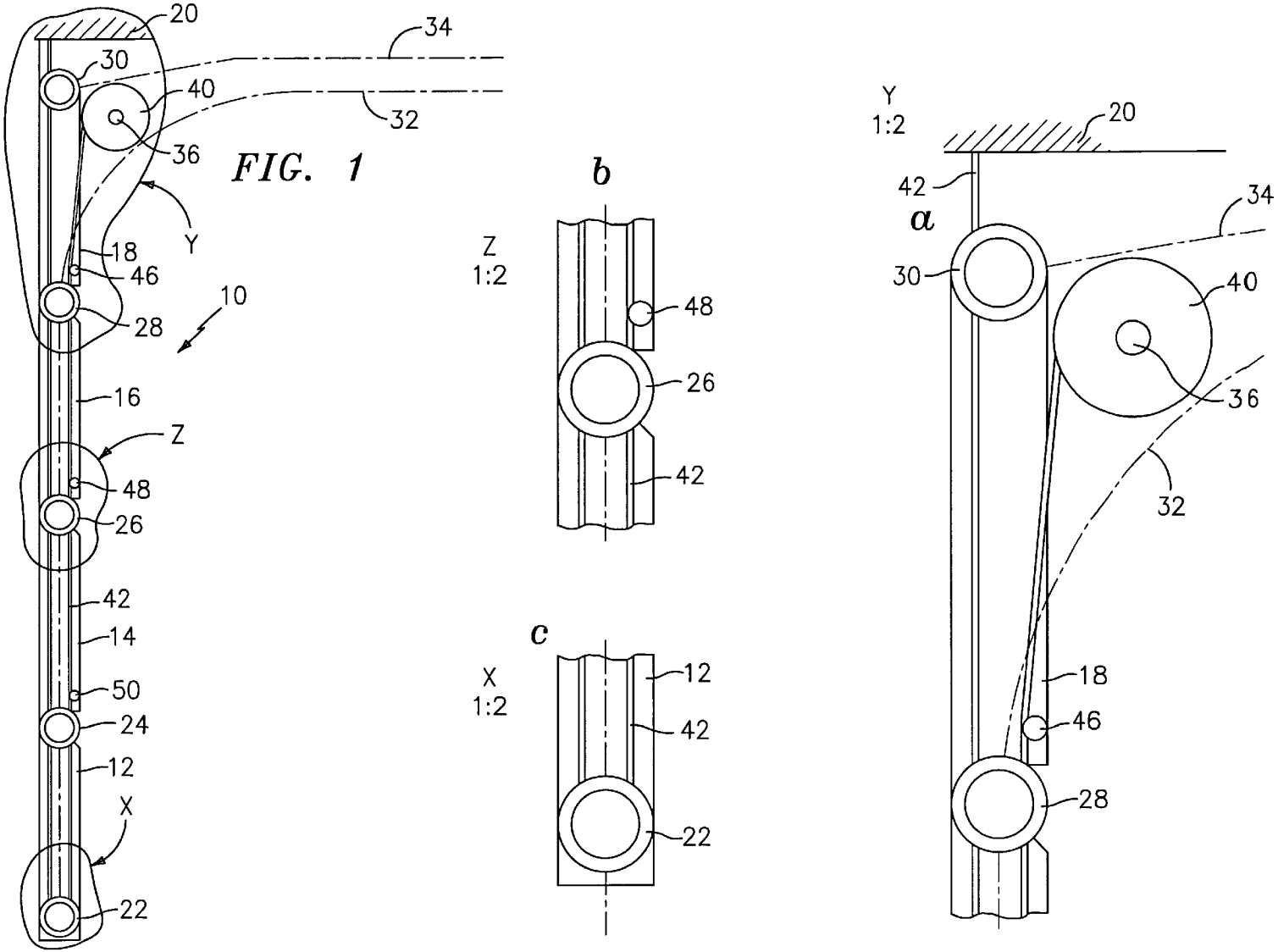

FIG. 1 shows a door 10 that in this case consists of a sectional door with four members 12, 14, 16, and 18 that can swivel relative to each other. The individual members 12, 14, 16, 18 of the door leaf are of the usual construction and consist, for example, of hollow aluminum or plastic profiles. The sectional door is guided on the side in a frame mounted on the building (not shown here in greater detail). The building shown here can, for example, be a garage. The garage roof is designated 20.

Figure 2:
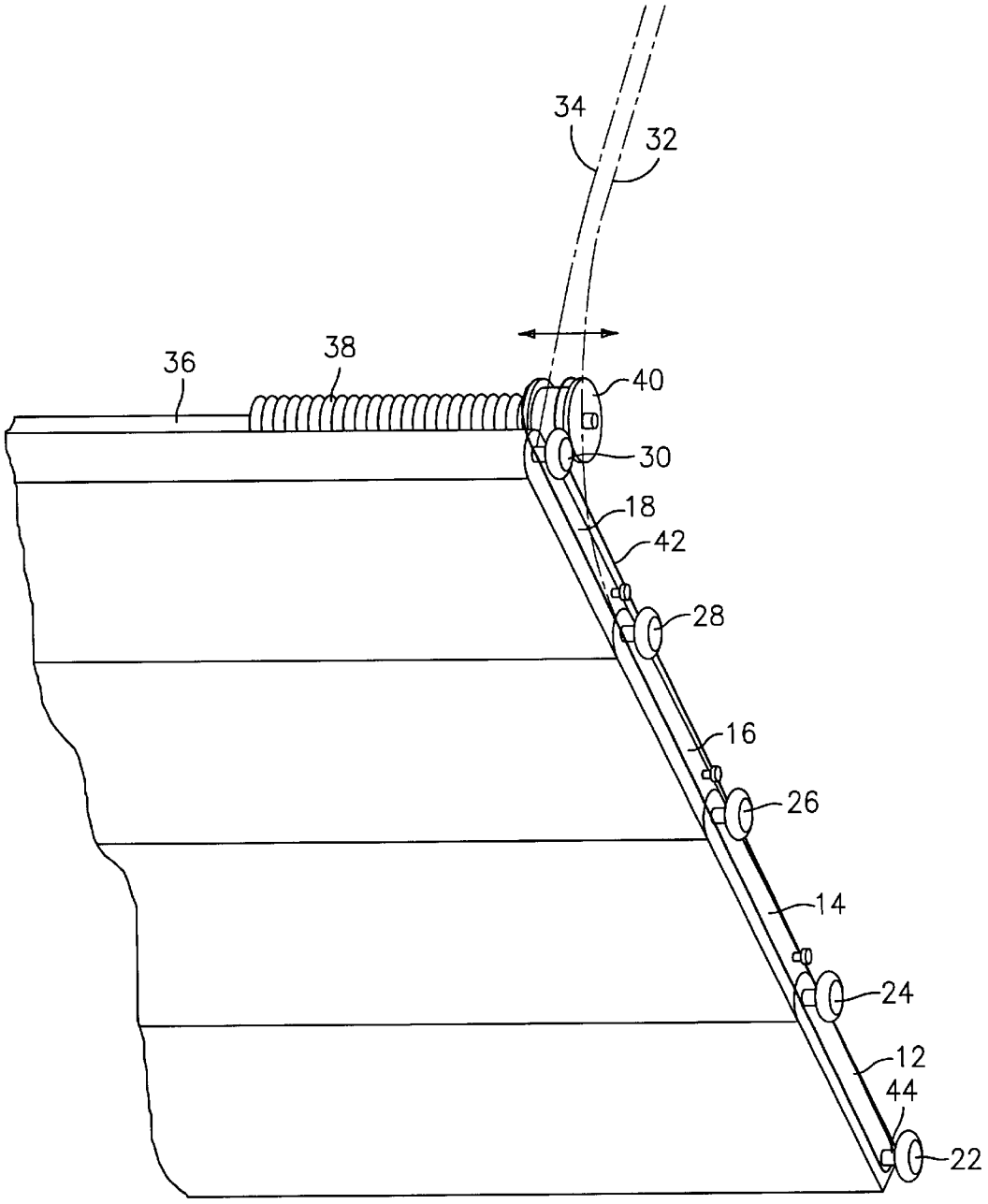
FIG. 2: a partially cut-away exploded view of the door according to the method of embodiment in FIG. 1, FIGS. 3 and 4: exploded detail drawing of the door leaf according to the method of embodiment in FIGS. 1 and 2, FIG. 5: a further method of embodiment of the door leaf according to the invention in a partial exploded view.
Figure 3:
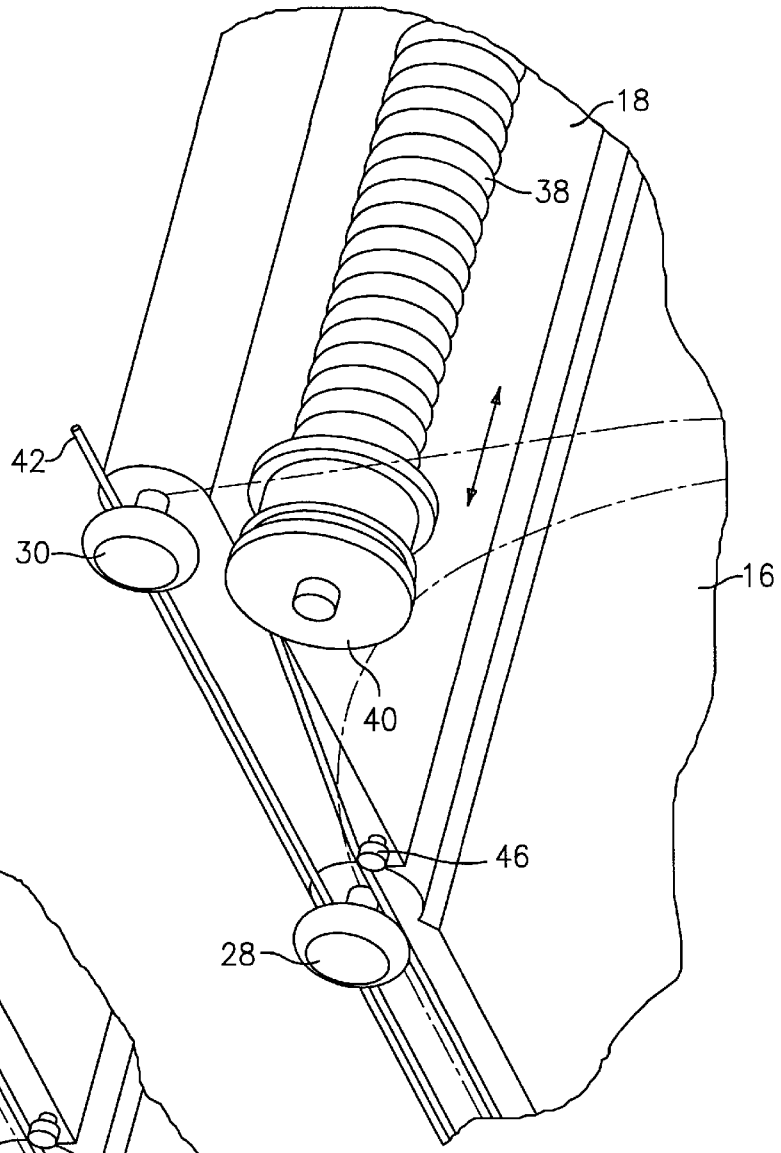

FIG. 1 shows the door leaf in the closed position. At the side of the door leaf, rollers 22, 24, 26, 28 and 30 are mounted; they run in the guides used to guide the entire door leaf (not shown here in greater detail). The guides are indicated in FIG. 1 by the dashed and dotted line. It is clear here that the rollers 22, 24, 26 and 28, during the opening and closing motions of the sectional door 10, run along the guide, indicated by dashed and dotted line 32, while the guidance roller 30 runs along the dashed and dotted tine 34. On the upper section of the topmost swiveling member 18 of the sectional door, pinion 36 is mounted; its course can be better seen in the exploded view according to FIG. 2. In the end regions of the pinion, helical springs that can be pre-tensioned by rotation are mounted. At the side edge, a cable drum 40 is mounted with the pinion 36 in a manner resistant to rotation. A cable 42 can be unrolled from the cable drum, against the force of the helical spring 38. The cable 42 is guided around a deflection roller 44 on the lower section of the bottommost swiveling member 12 of the door leaf and guided along the entire height of the door leaf up to a fixed point on the garage ceiling 20, where this cable 42 is fixed in a stationary manner.

Figure 4:
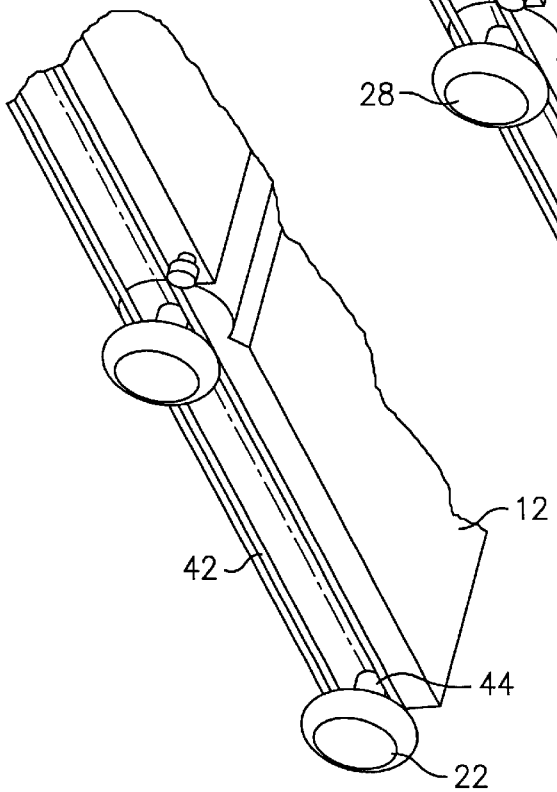

As can also be seen from FIG. 4, the deflection roller 44 is mounted in a rotating manner on the journal of roller 22. To guarantee guidance of the cable in the edge area of the door leaf during the upwards movement of the door 10, guidance rollers 46, 48 and 50 are provided along the height of the door leaf at the individual swiveling members of the door leaf.

Figure 5:
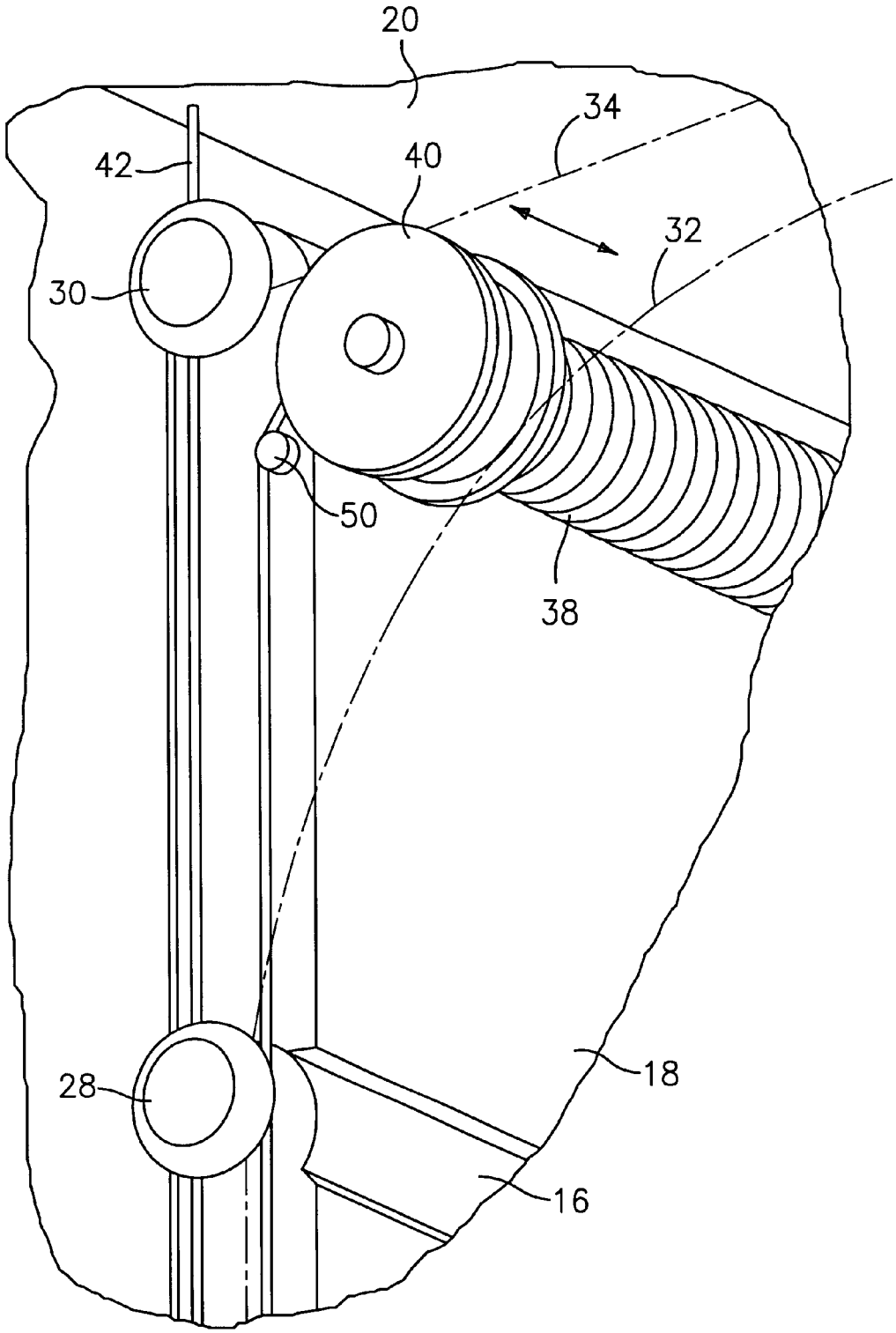

The essential parts of the method of embodiment according to FIG. 5 correspond to those according to FIGS. 1 through 4. The same parts are also designated with the same reference numbers. In any event, instead of guidance rollers 46, 48, 50, which, in the method of embodiment according to FIG. 1, are always mounted on the lower section of the members 14, 16 and 18, which can be moved against each other, a guiding pin 50' is mounted that has a low-friction surface. A single roller can also be provided instead of such a pin 50'.

Figure 6:
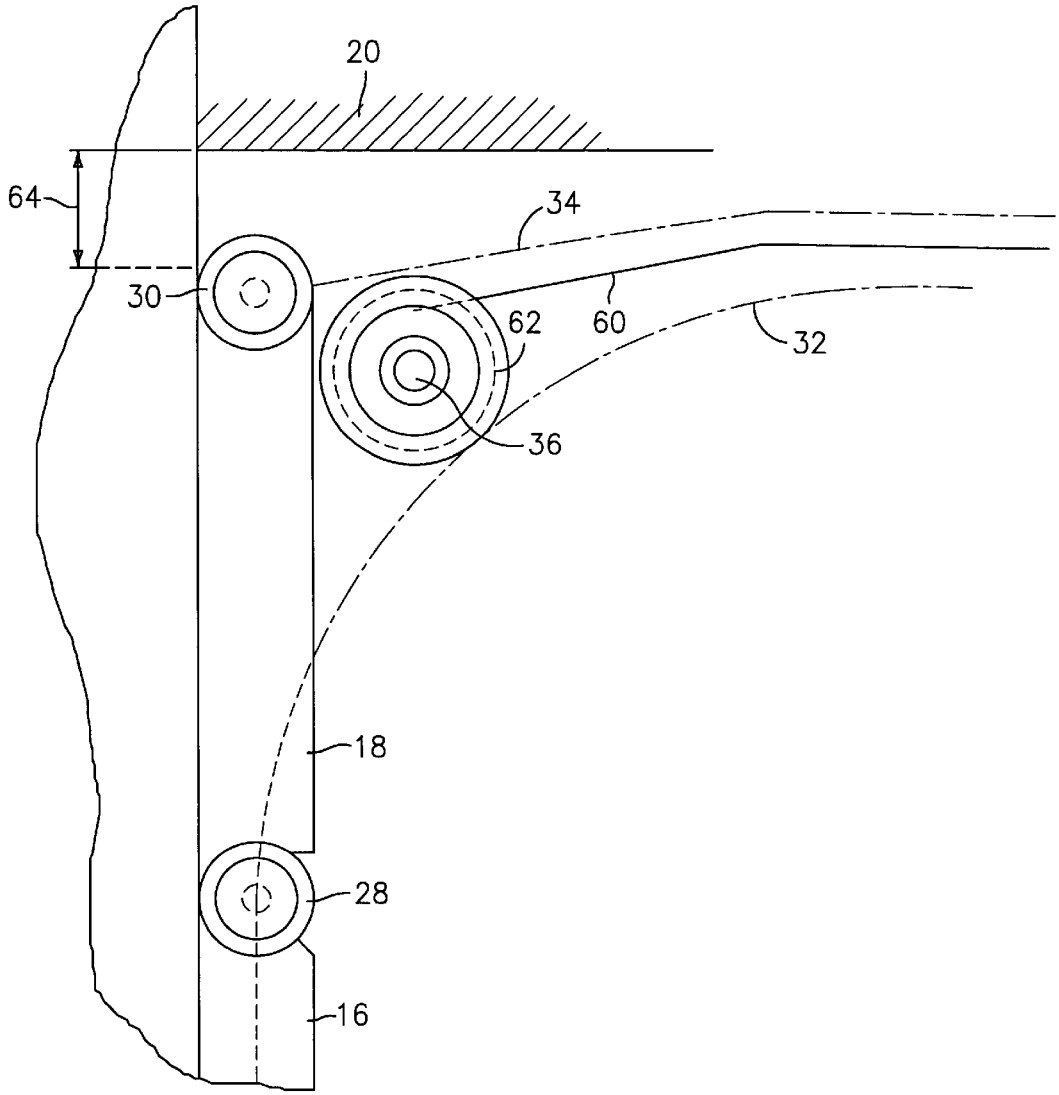
FIG. 6: a schematic cross-section through a portion of the door leaf according to a third method of embodiment of the invention.

A third method of embodiment of the invention is shown in FIG. 6. Here again, the same parts are designated with the same reference numbers.

The third method of embodiment offers an alternative to the solutions in the above-described methods of embodiment, which include a traction means. Here, a guide, rail with an integrated drive mechanism is mounted along the line of motion of the horizontal pinion 36, with which a transfer member is operationally coupled with the horizontal pinion in a rotation-resistant manner. In the method of embodiment shown here, guide rail 60 bears a chain as a drive mechanism, which is not shown in detail in the simplified drawing in FIG. 6. A chain wheel 62 connected solidly to the pinion 36 meshes with this as the transfer member. Such a chain wheel 62 can advantageously be mounted with a coordinated guide rail 60 with an integrated chain on both sides of the door leaf. The spring 38 is released or tensioned by the chain wheel 62 meshing with the chain, where the helical spring 38 is released approximately proportionally to the decrease in weight of the door leaf.

The lintel is designated 64 in FIG. 6; as is clear from the dimensions here, it can be minimized in comparison to previously-known doors with counterweight units mounted on the building.

What is claimed is:

1. Door with a door leaf comprising several members that are arranged to swivel relative to each other, and which is movable in a frame mounted on a building to be guided from a lateral side thereof, from a vertical closed position into at least an approximately horizontal open position, the door having a counterweight unit that is formed of at least one helical spring mounted on a horizontal pinion and arranged to be pre-tensioned by rotation, the pinion mounted directly on the door leaf with the helical spring, wherein the pinion is mounted on an uppermost swivelable member of the door leaf as positioned when the door is in closed vertical position.

2. Door according to claim 1, wherein the pinion with the helical spring has at least one drum and comprising a traction device arranged to unwind from the drum against force of the helical spring and which is guided at least around one deflection point on a lower most swivelable member of the door leaf as positioned in closed vertical position, a free end of the traction device being fixed on the frame or on the building.

3. Door according to claim 2, wherein the horizontally mounted pinion comprises two drums with a drum positioned at each opposite end thereof and comprising two traction devices each arranged to be guided on each respective side of the door leaf and wound around a respective drum.

4. Door according to claim 2, wherein rollers are mounted on sides of the swivelable members of the door leaf, by which the door is guided in side guides of the frame.

5. Door according to claim 4, wherein at least one traction device is guided around a roller mounted at the bottommost member of the door leaf.

6. Door according to claim 2, wherein guide rollers are mounted on the respective swivelable members of the door leaf for lateral guidance of at least one traction device.

7. Door according to claim 2, wherein a guiding pin is lateral mounted on at least one of the swivelable members of the door leaf, and arrange to guide at least one traction device thereover.

8. Door according to claim 1, wherein a guide rail having an integrated drive mechanism is mounted along a line of motion of the pinion upon the uppermost swivelable member, and having a force transfer member operationally coupled in a rotation-resistant manner with the horizontal pinion.

9. Door according to claim 8, wherein the drive mechanism integrated into the guide rail is a chain or toothed belt, while the force transfer member connected in a rotation-resistant manner with the horizontal pinion is formed as a chain wheel or toothed wheel meshing with the chain or toothed belt.

10. Door according to claim 8, wherein the guide rail is shaped as a rack profile, while the force transfer member connected in a rotation-resistant manner with the horizontal pinion is shaped as toothed disk meshing with the rack profile.

11. Door according to claim 8, wherein a friction surface is mounted in the guide rail as an integrated drive means, while the force transfer member connected with the horizontal pinion in a rotation-resistant manner is a friction wheel meshing with the friction surface.

12. Door according to claim 1, wherein a drive motor is provided in addition to the one helical spring mounted on the horizontal pinion.

13. Door according to claim 5, wherein the traction device is a cable attached at one free end thereof to a roof of the frame or the building and at an opposite end thereof wound about the rotatable drum and guided about rollers respectively positioned upon the swivelable members and around the deflection roller mounted upon the lowermost member of the door leaf.

14. Door according to claim 1, comprising a roller mounted respectively on each said swivelable member for guiding the same along the frame and arranged such that one of said rollers mounted upon said uppermost swivelable member in vertical position is positioned above said pinion and upon movement from the vertical closed position to the substantially horizontal open position of said swivelable members, said uppermost roller moves along a separate path from said remaining rollers.

15. Door according to claim 13, comprising a roller mounted respectively on each said swivelable member for guiding the same along the frame and arranged such that one of said rollers mounted upon said uppermost swivelable member in vertical position is positioned above said pinion and upon movement from the vertical closed position to the substantially horizontal open position of said swivelable members, said uppermost roller movies along a separate path from said remaining rollers.

16. Door according to claim 9, comprising a roller mounted respectively on each said swivelable member for guiding the same along the frame and arranged such that one of said rollers mounted upon said uppermost swivelable member in vertical position is positioned above said pinion and upon movement from the vertical closed position to the substantially horizontal open position of said swivelable members, said uppermost roller moves along a separate path from said remaining rollers.

17. Door according to claim 9, wherein the drive mechanism is integrated such that the spring is released or tensioned by the chain wheel meshing with the chain, such that the helical spring is released approximately proportionally to decrease in weight of the door leaf as the door is raised.

18. Door with a door leaf comprising several members that are arranged to swivel relative to each other, and which is moveable in a frame mounted on a building to be guided from a lateral side thereof, from a vertical closed position into at least an approximately horizontal open position, the door having a counterweight unit that is formed of a drive motor mounted on a horizontal pinion and arranged to rotate the horizontal pinion, the pinion being mounted directly on the door leaf with the drive motor, wherein the pinion is mounted on an uppermost swivelable member of the door leaf as positioned when the door leaf is in a closed vertical position, a guide rail having an integrated drive mechanism is mounted along a line of motion of the pinion upon the uppermost swivelable member as viewed laterally to the direction of movement, and having a force transfer member operationally coupled in a rotation-resistant manner with the horizontal pinion, and the drive mechanism integrated into the guide rail is a chain or toothed belt, while the force transfer member connected in a rotation-resistant manner with the horizontal pinion is formed as a chain wheel or toothed wheel meshing with the chain or toothed belt, respectively.

19. Door with a door leaf comprising several members that are arranged to swivel relative to each other, and which is moveable in a frame mounted on a building to be guided from a lateral side thereof, from a vertical closed position into at least an approximately horizontal open position, the door having a counterweight unit that is formed of a drive motor mounted on a horizontal pinion and arranged to rotate the horizontal pinion, the pinion being mounted directly on the door leaf with the drive motor, wherein the pinion is mounted on an uppermost swivelable member of the door leaf as positioned when the door leaf is in a closed vertical position, wherein the pinion with the drive motor has at least one drum and comprising a traction device arranged to unwind from the drum against force of the drive motor and which is guided around one deflection point on a lowermost swivelable member of the door leaf as positioned in closed vertical position, a free end of the traction device being fixed on the frame or on the building, and rollers are mounted on sides of the swivelable members of the door leaf by which the door is guided in sides of the frame.

* * * * *